US009405254B2

(12) United States Patent
Silvestri et al.

(10) Patent No.: US 9,405,254 B2
(45) Date of Patent: Aug. 2, 2016

(54) DEVICE FOR UNIFORM LIGHT INTENSITY GENERATION

(71) Applicant: Xerox Corporation, Norwalk, CT (US)

(72) Inventors: Markus R. Silvestri, Fairport, NY (US); Edward A. Domm, Hilton, NY (US); Mario Errico, Rochester, NY (US); Charles Hubert Henry Howes, Marion, NY (US); Martin John Hinckel, Rochester, NY (US); Surendar Jeyadev, Rochester, NY (US); Nancy L. Belknap, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 83 days.

(21) Appl. No.: 14/091,096

(22) Filed: Nov. 26, 2013

(65) Prior Publication Data

US 2015/0147075 A1 May 28, 2015

(51) Int. Cl.

| | |
|---|---|
| ***B41J 2/45*** | (2006.01) |
| ***G03G 15/00*** | (2006.01) |
| ***B41J 2/455*** | (2006.01) |

(52) U.S. Cl.

CPC ..... *G03G 15/5033* (2013.01); *B41J 2/451* (2013.01); *B41J 2/455* (2013.01)

(58) Field of Classification Search

CPC ..... G02B 26/127; G02B 7/00; G02B 7/022; G02B 7/023; H04N 1/4005; B41J 2/451; B41J 2/455; G03G 15/04054

USPC ..... 347/236, 238, 241, 245, 246, 256, 257, 347/263; 356/456, 482, 485, 489, 493, 495, 356/498, 503, 511

See application file for complete search history.

(56) References Cited

U.S. PATENT DOCUMENTS

| | | | | | |
|---|---|---|---|---|---|
| 5,017,755 | A * | 5/1991 | Yahagi | G02F 1/13439 | 219/121.68 |
| 5,166,751 | A * | 11/1992 | Massig | B82Y 35/00 | 356/495 |
| 5,299,219 | A | 3/1994 | Hayakawa | | |
| 5,703,487 | A * | 12/1997 | Mishra | G03G 15/75 | 324/456 |
| 5,793,784 | A | 8/1998 | Wagshul et al. | | |
| 6,970,252 | B2 * | 11/2005 | Knuttel | G01B 11/2441 | 356/497 |
| 8,217,973 | B2 | 7/2012 | Shioya et al. | | |
| 8,237,762 | B2 | 8/2012 | Ugajin et al. | | |
| 8,305,407 | B2 | 11/2012 | Taira | | |
| 8,891,090 | B2 * | 11/2014 | Nagahama | G01B 9/02057 | 356/497 |

* cited by examiner

*Primary Examiner* — Jason Uhlenhake
(74) *Attorney, Agent, or Firm* — Fay Sharpe LLP

(57) ABSTRACT

Described herein is a device that generates a beam of light with uniform intensity. The device includes an array of light sources. The light generated passes through a beam splitter. One beam is used for feedback to maintain uniform intensity. The other beam passes through a barrel which is used to mold the beam with uniform intensity into the desired shape and to reduce divergence. The device can be used as part of a quality control system for testing a photoreceptor drum.

16 Claims, 14 Drawing Sheets

DEVICE FOR UNIFORM LIGHT INTENSITY GENERATION

BACKGROUND

The present disclosure relates to a device for generating a beam or column of light with uniform intensity. This device is useful in quality control systems and for other applications needing uniform intensity in a light beam.

In an electrostatographic, electrophotographic or xerographic printing apparatus, an imaging member or photoreceptor comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in certain areas of the photoconductive insulating layer to create an electrostatic latent image. This electrostatic latent image may then be developed to form a visible image by depositing finely divided electroscopic toner particles, for example from a developer composition, on the surface of the photoconductive insulating layer. The resulting visible toner image can be transferred to a suitable receiving substrate such as paper. The photoreceptor is generally in the form of a cylindrical drum, with the photoconductive surface being the circumferential surface of the drum.

Current quality control tools for verifying the quality of imaging apparatus components use expensive and high maintenance exposure systems. Such tools typically include filtered halogen or xenon sources with bulky optics and require frequent calibration and maintenance. Light-emitting diode (LED) bars can be used as an exposure source. However, LED bars are difficult to implement in a fixture that is adjustable for measuring multiple drum diameters and lengths while avoiding mechanical interference. Light from these sources is shined upon the photoreceptor drum during the quality control process.

Requirements for the light exposure system of the quality control testing system are very stringent. High uniformity is required along the photoreceptor drum axis. Perpendicular to this axis, i.e. in the circumferential or process direction, the beam cannot diverge. The beam must be narrow, both to minimize stray light and to minimize changing transmission at the air/transport layer interface due to the changing incident angle of the curving surface of the photoreceptor drum. A narrow beam is also required for the underfill requirement of the calibrating detector.

The best uniform light exposure sources are obtained through integrating spheres. An integrating sphere is a hollow spherical cavity with a reflective interior, with small holes for entrance and exit ports. Light rays incident on any point on the inner surface are, by multiple scattering reflections, distributed equally to all other points, so that the exiting light is uniform. However, the drawback is the heavy loss of power and large divergence (increase in beam diameter with distance from the aperture) at the exit port. As a result, either the test surface has to be brought close to the exit port or the light needs to be captured by some means, such as fiber bundles. However, this has been found to be impractical in practice, because the fiber bundles must be very large to provide a rectangular exit aperture. This large size in turn cuts down the integrating sphere throughput efficiency. In addition, the intensity may fluctuate if the fibers are moved, even in the case of multimode fibers that reduce modal hopping.

It would be desirable to develop new devices for that can generate light of uniform intensity.

BRIEF DESCRIPTION

The present disclosure relates to devices for generating a column or beam of light that has uniform intensity. Such devices are useful in systems and methods for performing quality control.

Disclosed in various embodiments is a testing system, comprising: at least one device for generating a column of light having uniform intensity, the device comprising: a housing; a beam splitter located within the housing; a two-dimensional array of light sources on a wall of the housing, the array being oriented towards the beam splitter such that light is split into a first beam and a second beam; a detector port located to intercept the first beam for providing feedback; and an exit aperture on a front wall of the housing, through which the second beam exits the housing as a column of light having uniform intensity; the at least one device being oriented with the exit aperture pointing towards an open central axis.

Sometimes, the array of light sources is directly opposite the exit aperture.

The front wall of the housing may include an inner aperture located between the beam splitter and the exit aperture. The inner aperture and the exit aperture may be separated by a barrel that includes an interior barrel surface and has an aperture separation length, and wherein a form and size of the exit aperture, a form and size of the inner aperture, and the aperture separation length are independently adjustable.

In alternative embodiments, a light channel extends from the beam splitter through the exit aperture.

The system can further comprise a mirror opposite the array of light sources, such that the second beam passes through the beam splitter, reflects off the mirror back towards the beam splitter, and then exits through the exit aperture.

The exit aperture can be circular or rectangular in shape.

The two-dimensional array of light sources can be a light-emitting diode (LED) array. The LED array is, in certain embodiments, a rectangular array containing five rows of twelve AlGaAs diodes.

The at least one device of the system can further comprise an alignment source oriented towards the beam splitter which generates an alignment beam that is reflected by the beam splitter and exits the housing through the exit aperture parallel with the column of light. The alignment source may be located opposite the detector port.

The detector port can include a photodiode that provides feedback to control the power applied to the two-dimensional array of light sources, the light sources being controlled as a group.

The system may further comprise: a plurality of congruent rings spaced apart from each other along the open central axis, each ring having its center on the open central axis; and a rail spanning the plurality of congruent rings; wherein the at least one device is located on the rail. The system may have a total of two congruent rings.

Also disclosed in embodiments herein is a method for assessing the quality of a photoreceptor comprising: securing the photoreceptor along a central axis of a testing system, wherein the testing system comprises at least one device for generating a column of light having uniform intensity, the device comprising: a housing; a beam splitter located within the housing; a two-dimensional array of light sources, the array being oriented towards the beam splitter such that light is split into a first beam and a second beam; a detector port located to intercept the first beam for providing feedback; and an exit aperture on a front wall of the housing, through which the second beam exits the housing as a column of light having uniform intensity; and rotating the photoreceptor while the at least one device illuminates the photoreceptor from a static position.

The testing system can further comprise a plurality of congruent rings spaced apart along the central axis; and a rail spanning the plurality of congruent rings; wherein the at least one device is located on the rail.

A working distance between the front wall and the photoreceptor can be 50 millimeters or less.

Also disclosed herein in embodiments is a device for generating a column of light having uniform intensity, comprising: a housing; a beam splitter located within the housing; a two-dimensional array of light sources on a wall of the housing, the array being oriented towards the beam splitter such that light is split into a first beam and a second beam; a detector port located to intercept the first beam for providing feedback; and an exit aperture on a front wall of the housing, through which the second beam exits the housing as a column of light having uniform intensity.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
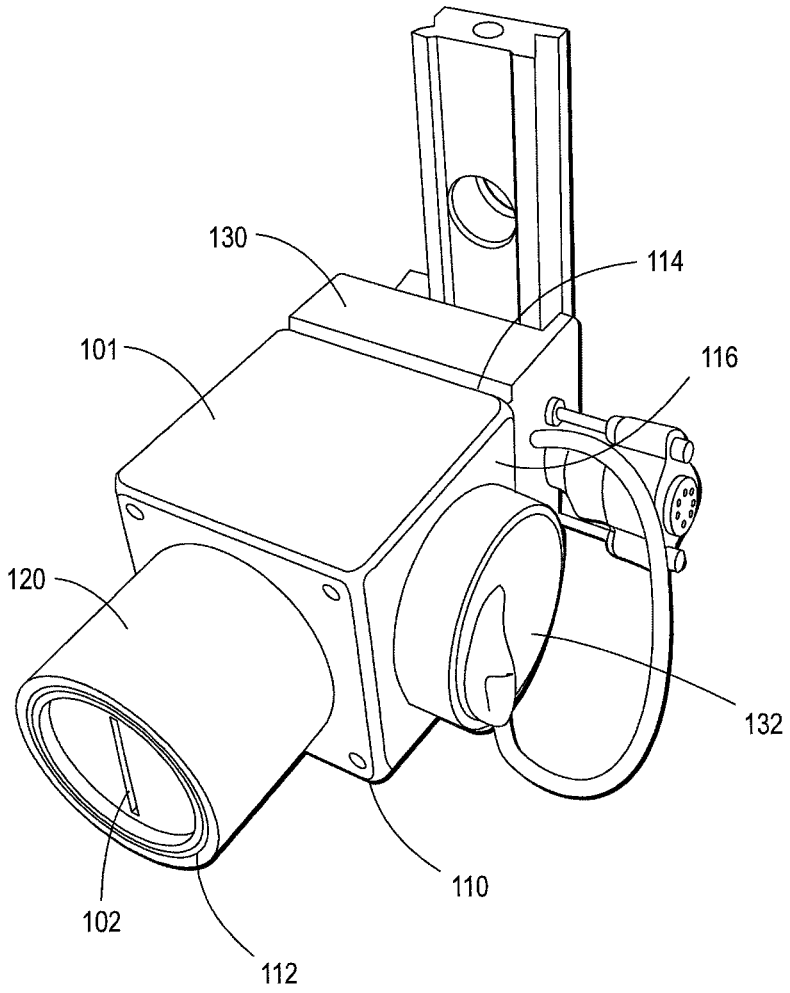
FIG. 1 is a picture of an implemented device of the present disclosure, which is a first exemplary embodiment thereof.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values). A value modified by a term or terms, such as "about" and "substantially," is not limited to the precise value specified. The modifier "about" should also be considered as disclosing the range defined by the absolute values of the two endpoints. For example, the expression "from about 2 to about 4" also discloses the range "from 2 to 4."

It should be noted that some of the terms used herein are relative terms. For example, the terms "front" and "back", or the terms "left" and "right", are in completely opposite directions from each other relative to a center. A "side" will extend from the "front" to the "back", and will not pass through the center, and more than one side may be present for a given structure. For example, a cube may be described herein as having a front wall and a back wall (which are on opposite ends of the cube) and four side walls. The terms "upstream" and "downstream" are relative to the direction in which a particle passes through various components, i.e. the particle passes through an upstream component prior to passing through the downstream component. It is possible for a given component to be both "upstream" and "downstream" of another given component, for example if the particle passes in a loop.

The terms "perpendicular" and "parallel" are used to indicate relative angles between two named components, but should not be construed as referring to only 90° or 180° relationships. Rather, a plus-minus (±) 2° tolerance in either direction is acceptable.

It is noted that some aspects of this disclosure refer to the dimensions of various apertures, and that the apertures can take different shapes, e.g. circular or rectangular. In some embodiments, the term "diameter" is used for convenience to refer to the size of the aperture. The use of this term should not be construed as limiting the shape of that particular aperture to a circular shape.

The present disclosure relates to devices for generating a column of light having uniform intensity. The term "intensity" here refers to the one dimensional power density of the column of light along the relevant dimension (units: watts/m). The column of light will form a two-dimensional shape on a flat surface, i.e. the column of light has an area. The other, non-relevant dimension is integrated by the detector aperture. The term "uniform" means that the intensity varies by 2% or less within the column of light. It is noted that the column of uniform intensity may be located within a larger column of light. For example, in a column of light having a diameter of 15 mm, the column of light having uniform intensity may be in the center of the column and have a diameter of only 4 mm, with the remaining annular area not having uniform intensity.

The devices of the present disclosure are particularly useful in testing systems used for quality control of photoreceptors. Conventional testing systems will use one long unit for providing light along the drum axis of the photoreceptor. The devices of the present disclosure are much shorter, and it is contemplated that the testing system will have a plurality of these shorter devices, which can be tightly controlled through an internal feedback system. This configuration enables flexibility and precision across axial measurement locations.

Generally, in the light-generating devices of the present disclosure, uniformity is achieved by structures that operate as spatial filters and beam-forming apertures. The interior surfaces are designed either to guide light for high throughput, or to trap and absorb light to generate a narrow but wide beam (i.e., a beam with a high aspect ratio).

FIG. 1 is a picture providing a perspective view of a working model of a device of the present disclosure that generates a column of light having uniform intensity. The device 100 includes a housing 101. Here, the housing includes two different portions, shown as a cuboid base 110 and a cylindrical barrel 120. The cylindrical barrel 120 includes a front wall 112 of the housing, and an exit aperture 102 is located therein (here, the exit aperture has a rectangular shape). The back wall 114 of the housing includes a two-dimensional array 130 of light sources. One side wall 116 includes a detector port 132, which is used to monitor the light being generated and provide feedback to the array of light sources. The housing can be made of conventional materials known in the art. It is noted that the housing is discussed as being a unitary component. However, the housing can also be made by the uniting of two separate components, i.e. in more desirable embodiments the cuboid base and the cylindrical barrel are made separately and then joined together.

Figure 2:
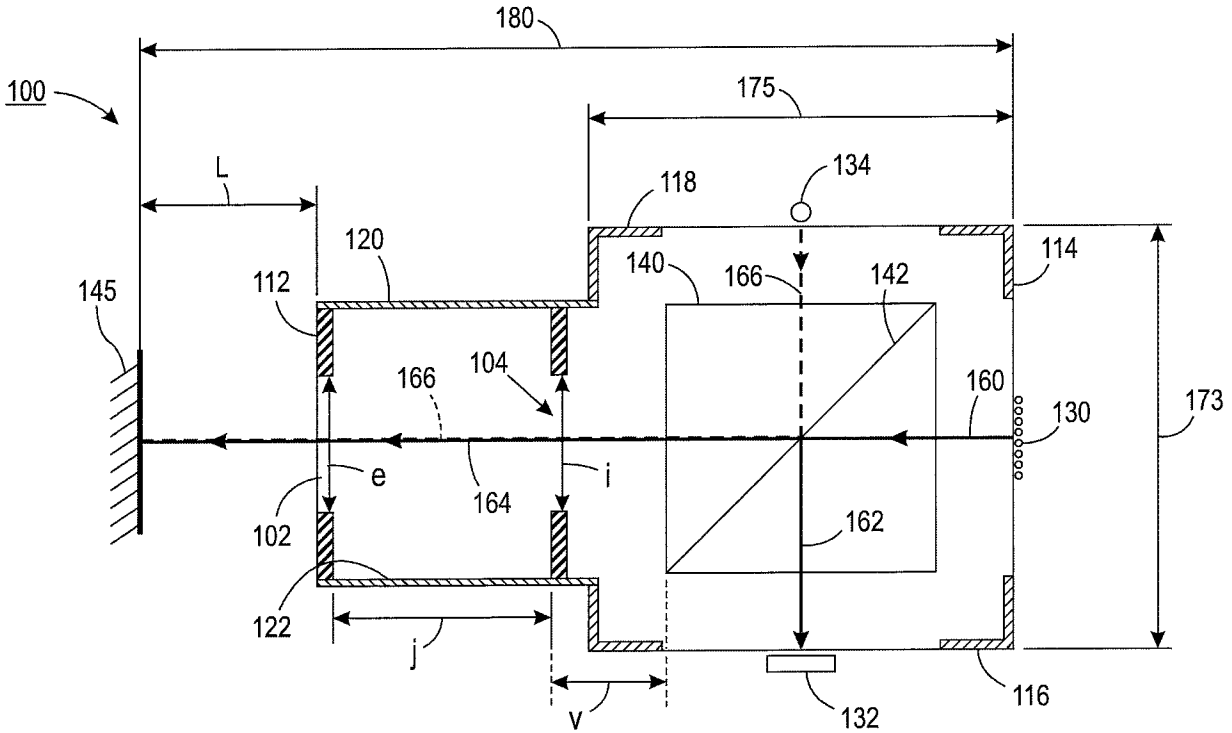
FIG. 2 is a cross-sectional plan view showing an internal arrangement of the device for generating uniform light of the present disclosure illustrated in FIG. 1. Slits denoted by reference numerals 102 and 104 are rotated to show their lengths 'e' and 'i' for illustration purposes.

FIG. 2 is a cross-sectional plan view of a first exemplary embodiment of a uniform intensity light generating device 100 of the present disclosure, and illustrates the internal arrangement of the components seen in FIG. 1. The cylindrical barrel 120 is visible on the left side of the figure, and the exit aperture 102 is located on the front wall 112. The two-dimensional array 130 of light sources is present on the back wall 114, i.e. the array of light sources is directly opposite the exit aperture.

Figure 3:
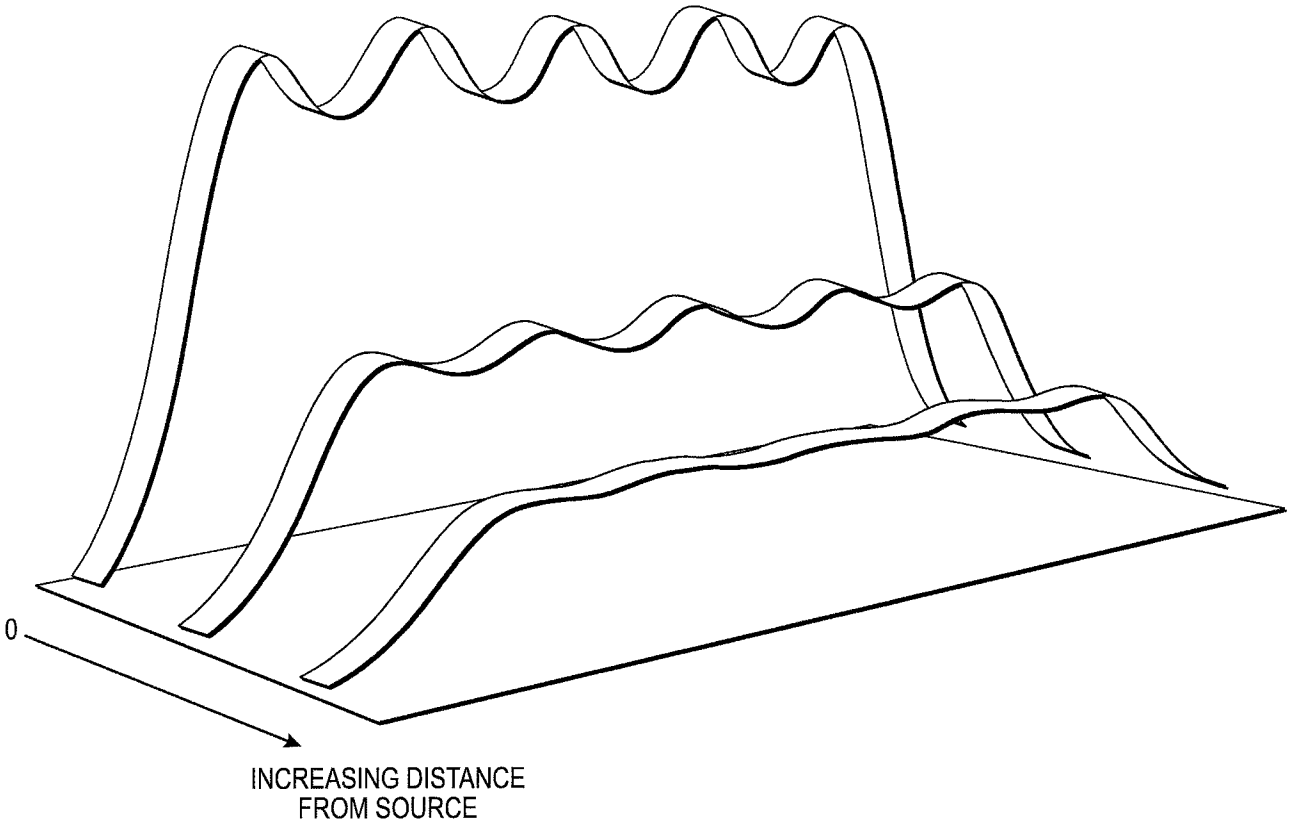
FIG. 3 is a figure illustrating the uniformity in power distribution as a function of distance for five Gaussian beam sources having a 20 degree divergence angle, with the distance from the source increasing in the direction of the arrow.

In particular embodiments, the two-dimensional array 130 of light sources is an array of light-emitting diodes (LEDs). In more specific embodiments, the LEDs are aluminum-gallium-arsenide (AlGaAs) diodes. The use of a two-dimensional array is based on the observation that the using multiple equidistant divergent light sources having a Gaussian-like distribution together will result in a light source having a distribution that is uniform at its center. This is illustrated in FIG. 3, which shows the power distribution as a function of distance for five equidistant Gaussian light sources spaced along an axis having a 20° divergence angle. The distance increases in the direction of the arrow. At low distance, the peaks of the five waves are visible. At further distance, they start to merge. At the furthest distance, the distribution is relatively uniform at the center.

It is noted that the term "two-dimensional" refers to the light sources being generally located in the same plane, and should not be construed to require each light source as being flat. The term "array" refers to the presence of more than one light source and to the light sources being arranged in a regular pattern. For example, the light sources may be arranged in a rectangular pattern, forming rows or columns. Alternatively, the light sources may be arranged in a series of concentric circles. In some specific embodiments, the light sources are arranged in a rectangular array containing five (5) rows and twelve (12) columns. Such arrays are commercially available, for example from Marubeni Corporation, California. The light source can be tuned to emit light within a certain wavelength range or at a given maximum wavelength ($\lambda$max). In embodiments, the light source emits within a range of 700 nanometers (nm) to 1000 nm, or in embodiments at a $\lambda$max of about 780 nm.

Referring back to FIG. 2, a beam splitter 140 is located within the housing 101, and is illustrated here as a cube that contains a surface 142 which divides an incoming light beam 160 into two separate light beams, a first beam 162 and a second beam 164. As arranged here, the two-dimensional array 130 of light sources is oriented so that the light generated therefrom 160 hits the beam splitter 140 and is split. The first beam 162 bends 90° and is directed to a first side wall 116, where the detector port 132 is located. The second beam 164 continues to the exit aperture 102 and exits the housing, forming the column of light having uniform intensity. The beam splitter 140 is illustrated here in the form of a cube, made by joining two triangular prisms together and adjusting the thickness so that at a given wavelength, half of the light is reflected and half of the light is transmitted. Alternatively, a pellicle mirror can be used as a beam splitter. Beam splitters are commercially available, for example from Thorlabs of New Jersey.

The detector port 132 includes a photodiode and is used to monitor the intensity of the generated light beam. The photodiode can control the voltage applied to the two-dimensional array of light sources 130 to control the total power output of the light being generated. Photodiodes are commercially available, for example from Texas Instruments.

Also present on a different side wall 118 is an alignment source 134, which is also oriented towards the beam splitter 140. An alignment beam 166 is generated by the alignment source, which is reflected by the surface 142 of the beam splitter to travel parallel with the second beam/column of light 164 and exit the housing. The alignment source is useful when the light coming from the two-dimensional array 130 is in the infrared range (e.g. $\lambda$=780 nm) and hence not visible to the naked human eye. The alignment source 134 provides visible light on the test surface 145 for alignment purposes during setup. The alignment source 134 is independently controlled from the two-dimension array, so it can be turned off after alignment when the column of uniform light is being generated. The alignment source 134, as shown here, is located opposite the detector port 132 on the opposite side of the beam splitter. The alignment source can be any light-generating device, such as an LED or a laser. The wavelength of the alignment source is usually different from that of the second beam 164, and is intended to be visible to the naked human eye.

The exit aperture 102 is located on the front wall 112 of the housing. In some embodiments, an inner aperture 104 is located between the beam splitter 140 and the exit aperture 102. Here, the inner aperture and the exit aperture are at opposite ends of the barrel 120. As illustrated here, the exit aperture 102 is rectangular in shape, and has a length e. Similarly, the inner aperture 104 is illustrated as being rectangular in shape with a length i. The widths are not shown. The barrel 120 includes an interior surface 122, and has an aperture separation length j that separates the two apertures 102, 104. The exit aperture, inner aperture, and barrel surface can be used to "clean up" the second beam by trapping unwanted stray and reflected light, for example by blocking divergent light rays from exiting through the exit aperture. In conjunction with the exit aperture, the inner aperture also works as a spatial filter, in particular by blocking light rays that enter the beam splitter at incident angles large enough to reflect off the beam splitter side walls. It is again noted that the beam splitter is located within the housing, and the distance between the beam splitter 140 and the inner aperture 104 is indicated here as length v. The exit aperture size e, the inner aperture size i, the aperture separation length j, and the distance v can be independently adjusted as needed to maintain the uniformity of the light and to reduce the divergence of the light. Methods of making such structures are known in the art. The exit aperture can have any shape needed so that the column of light being emitted has the desired shape for the given application. For example, the exit aperture can be circular or rectangular. In FIG. 1, the exit aperture is rectangular. For reference purposes discussed further herein, the back wall 114 of the housing has a length 173, and the side wall 116 has a length 175.

Also shown in FIG. 2 is the test surface 145 to which the column of light is directed. The distance between the front wall 112 (containing the exit aperture 102) and the test surface 145 is marked here with reference letter L, and is referred to as the working distance. The total distance of the optical path from the array of light sources to the test surface is marked with reference numeral 180.

Figure 4:
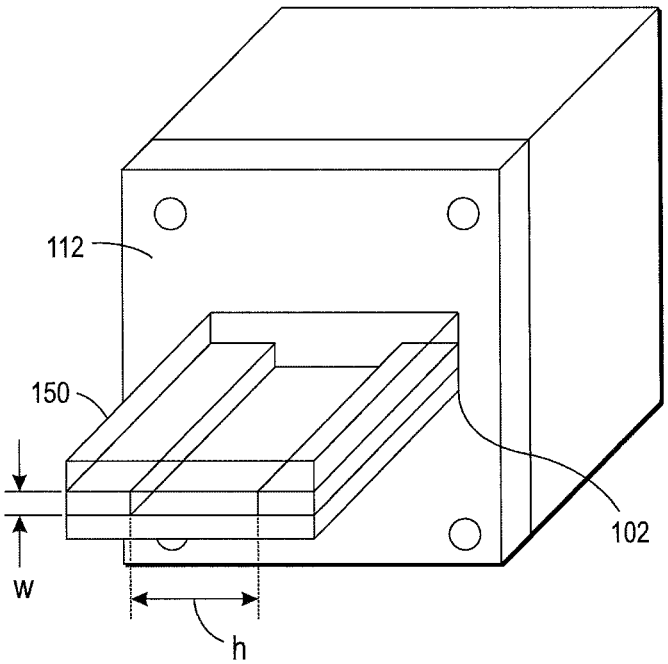
FIG. 4 is a front perspective exterior view of a second exemplary embodiment of a device for generating uniform light of the present disclosure.
Figure 5:
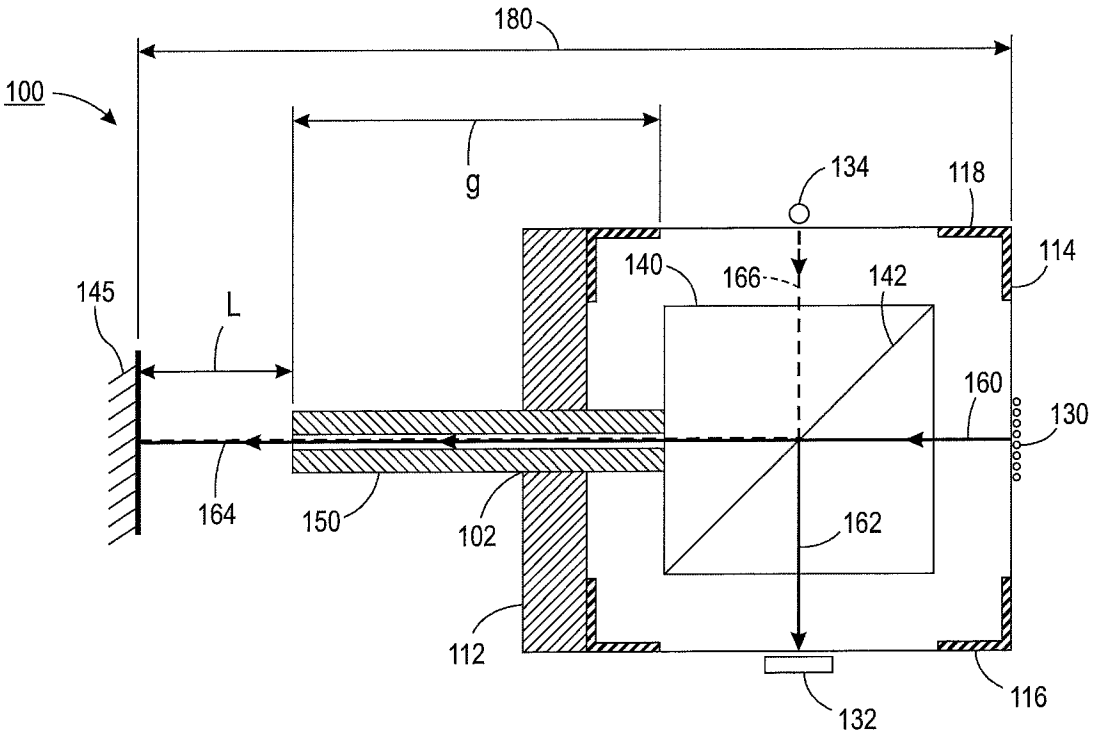
FIG. 5 is a cross-sectional plan view showing the internal arrangement of the device of FIG. 4.

FIG. 4 and FIG. 5 are views of a second exemplary embodiment of a device for generating a column of light having uniform intensity. FIG. 4 is a front perspective view, and FIG. 5 is a side cross-sectional view. This embodiment includes the array 130 of light sources on the back wall 114, the detector port 132 on a first side wall 116, the alignment diode 134 on a second side wall 118, and the exit aperture 102 on the front wall 112. This embodiment differs in that rather than having an inner aperture and a barrel, a light channel 150 extends from the beam splitter 140 through the exit aperture 102. This light channel operates as a wave guide and is designed to transport light for a given distance with minimal loss by means of total internal reflection. The light channel can be made from optical grade materials including acrylic, polycarbonate, epoxy, and glass. Again, the light channel can be made in any desired shape, such as circular or rectangular. The light channel is not restricted to total internal reflection; the surfaces may also be absorbing. As a result, the beam width at the exit can be narrower at the expense of less light throughput. A narrow beam width is desired and can be dialed in if the power output of the source allows it. As illustrated in FIG. 4, the light channel 150 has a rectangular shape, having a height w and a width h to which the emitted column of light should correspond. The light channel also has a length g as shown in FIG. 5. In FIG. 5, the total distance 180 and the working distance L relative to the test surface 145 are also illustrated.

Figure 6:
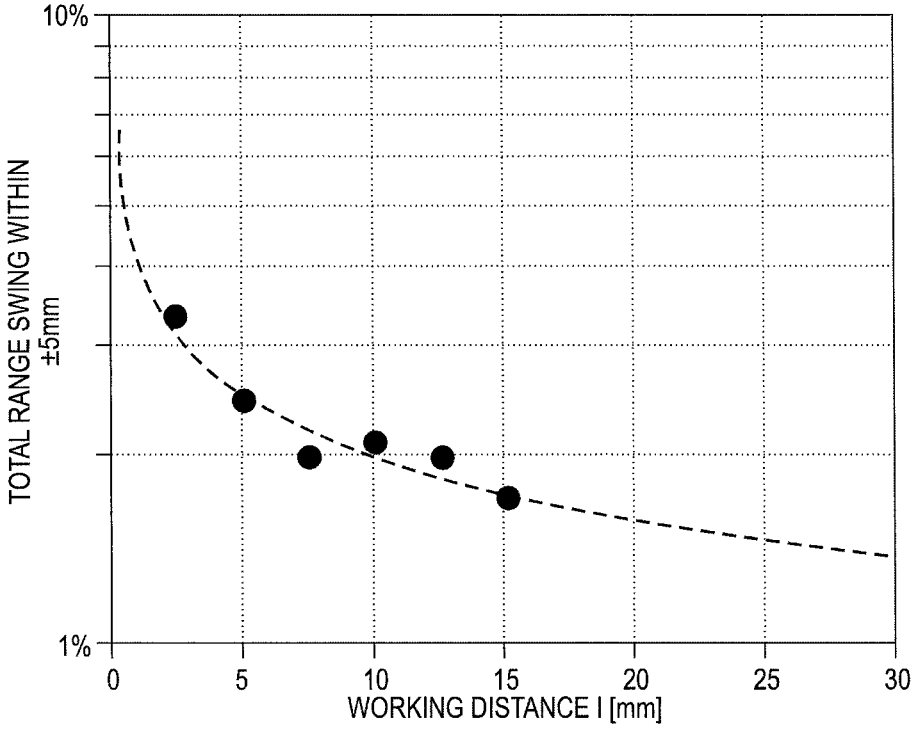
FIG. 6 is a graph showing the total variation in light intensity over a ±5 mm range versus the working distance (from the exit pupil of the light source to the target surface).
Figure 7:
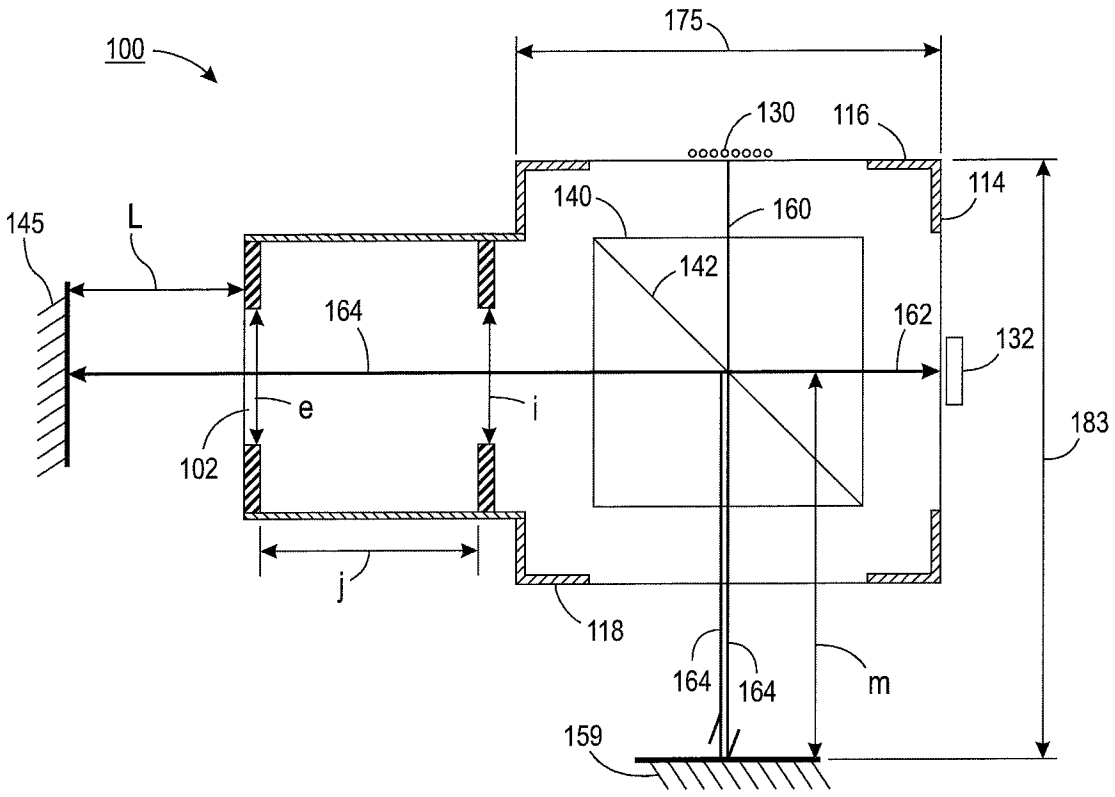
FIG. 7 is a schematic of a third exemplary embodiment of a device for generating uniform light of the present disclosure. This embodiment includes a mirror that is used to lengthen the optical path, i.e. the total distance from light array to test surface, without changing the working distance (between front of device and test surface).

Referring now to FIG. 2, the working distance L between the exit aperture and the test photoreceptor surface is generally desired to be as small as possible, to maintain control over the beam width in the process direction. However, referring now to FIG. 3, it is seen that as the distance from the array of light sources increases (i.e. the total distance), the uniformity of the light also increases. FIG. 6 illustrates the total swing in the intensity profile over a ±5 mm range (from the center of the column of light) when plotted against the working distance. This shows that as the working distance increases, the difference in intensity decreases, or in other words the intensity becomes more uniform. Put another way, the longer the optical path between the array of light sources and the test surface (i.e. the total distance 180), the more uniform the intensity of the light FIG. 7 illustrates a third exemplary embodiment in which the total distance 180 of the optical path of the column of light is increased, while the size of the housing is only partially changed. In FIG. 7, the array 130 of light sources is moved to a first side wall 116, the detector port 132 is moved to the back wall 114 of the housing, and a mirror 159 is placed on a second side wall 118 opposite the first side wall 116. The orientation of the beam splitter 140 is also changed by 90 degrees. Comparing FIG. 7 to FIG. 2, the side wall length 175, the aperture separation length j, and the working distance L are the same. However, the length 183 of the back wall in FIG. 7 can be the same as or longer than the length 173 of the back wall in FIG. 2.

In FIG. 7, the light 160 emitted by the array of light sources is split into a first beam 162 and a second beam 164. The first beam bends 90° towards the back wall where the detector port 132 is located, and is used for feedback. The second beam, rather than being sent directly to the exit aperture 102, instead travels to the mirror 159 on the second side wall and is then reflected back to the beam splitter surface 142, where the second beam is then bent 90° towards the exit aperture 102. The additional distance traveled by the second beam is indicated here with the reference letter m, and increases the total distance of the optical path by 2m compared to the total distance 180 of FIG. 2. This design also has the additional benefit that the beam width of the column of light does not increase because the working distance L between the exit aperture 102 and the test surface 145 is kept constant.

The devices described above generate a column or beam of light that has uniform intensity and has a desired shape. These devices can be used in a testing system that is used for quality control of photoreceptor drums.

Figure 8:
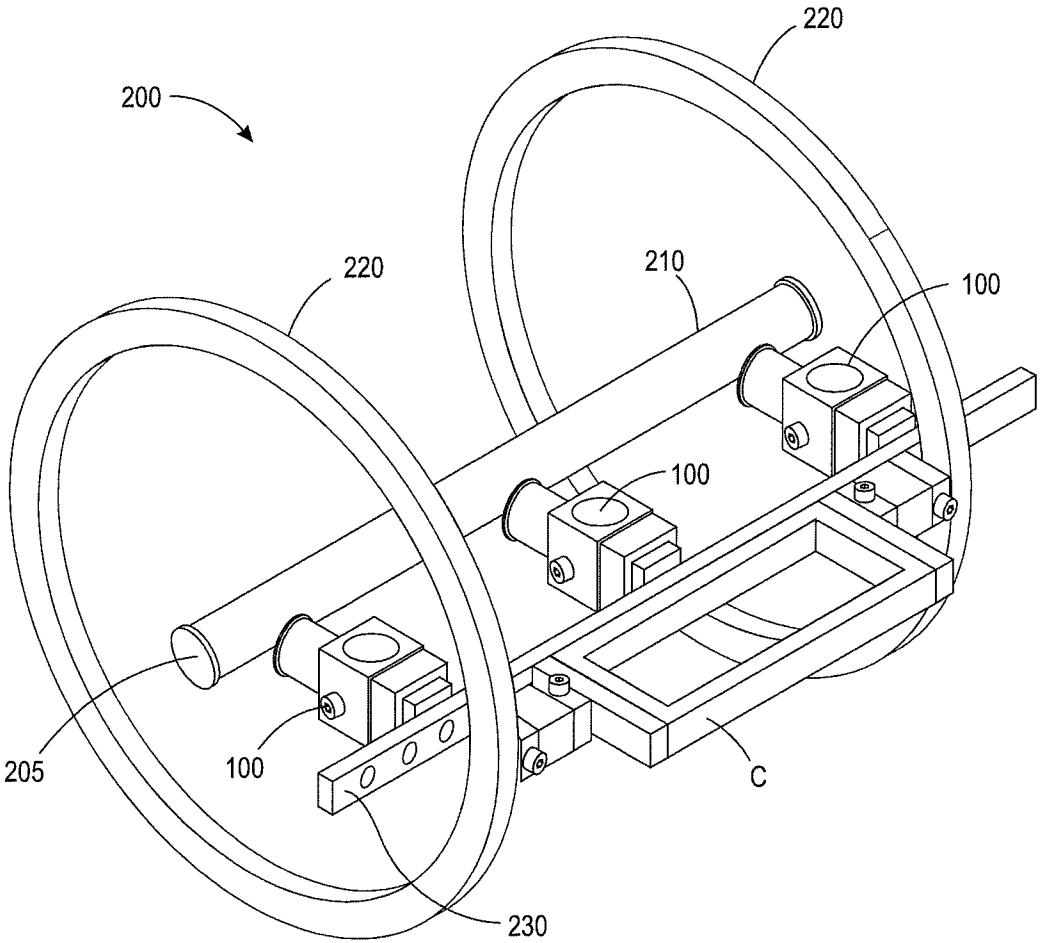
FIG. 8 is a perspective schematic of a quality control system that uses the devices of the present disclosure.

FIG. 8 is a perspective view illustrating an exemplary testing system 200 of the present disclosure and a photoreceptor drum 210. Here, the photoreceptor drum is located along a central axis 205 of the system, which will also be referred to as an open central axis. A plurality of congruent rings 220 (i.e. rings having the same diameter) are spaced apart from each other along the central axis. Put another way, the center of each ring is located along the central axis. A rail 230 spans the rings, i.e. joins the rings together. Here, there are two rings 220, and they are located at opposite ends of the rail 230. A plurality of the devices 100 are attached to the rail. As illustrated here, there are three devices, and their exit aperture is oriented towards the central axis (i.e. where the photoreceptor will be located). Each device is connected to the rail by their back wall. The location of each device can be adjusted along the rail, so that different parts of the photoreceptor can be tested. In use, the uniform-light-generating sources expose different regions of the photoreceptor, and the photoreceptor surface is tested. Either the photoreceptor drum may be rotated while the sources remain stationary, or the sources may be rotated circumferentially about the stationary photoreceptor drum. The plurality of shorter light generating devices can be tightly controlled through an internal feedback system, enabling flexibility and precision across axial measurement locations.

In this regard, uniformity of intensity along the drum axis is critical whereas perpendicular to it (i.e., in the circumferential or process direction), uniformity is not critical due to the rotation. The beam width in the process direction should be controlled because the calibrating detector needs to be under-filled. Additionally, individual rays of large divergent beams will have different incident angles at the photoreceptor surface and thus have different power transmissions.

The present disclosure will further be illustrated in the following non-limiting examples, it being understood that the examples are intended to be illustrative only and the disclosure is not intended to be limited to the materials, conditions, process parameters, and the like recited herein.

EXAMPLES

Example 1

A device similar to the structure of FIG. 1 and FIG. 2 was used where the aperture separation length was zero (i.e. only a cuboid base, no cylindrical barrel). A non-polarizing, 1-inch beam splitter cube rated for 700 to 1,000 nm was used. The beam splitter cube was located about 6 mm below the surface of the housing. The light source was a high-powered LED array of five rows of twelve AlGaAs diodes on a chip operating at 780 nm (L780-66-60, Marubeni Corp., California). The power of the LED array was controlled through a voltage-controlled current source. The light output was held constant through a feedback from a monitoring photodiode at the detector port. The photodiode was integrated with an amplifier in the integrate circuit OPT101 from Texas Instruments to provide a voltage signal for feedback.

The linear or one-dimensional power density distribution was measured along the critical direction (i.e., along the drum axis) using a silicon detector having a rectangular aperture of 8 mm×1 mm. The 1 mm was along the critical direction, the drum axis, where the uniformity is tested, and the 8 mm was along the beam width (The 1 mm slit width is close to the resolution of the electrostatic voltmeter probes that measure the photoreceptor surface potential). The beam width was below 8 mm; hence, was fully captured. The detector with this aperture was then moved along the drum axis. Its output and its position were recorded to produce the intensity or power density distribution. The power distribution could be measured in two axes sequentially by simply rotating the above arrangement (i.e. the critical direction along the axis of the photoreceptor drum, and the process direction or radius of the drum). In the Examples, the relative power density distribution (relative to the center value) in the critical direction is reported for easy comparison and assessment of variation The power distribution of the device was measured through a circular exit aperture in the cuboid base which was about 25.4 mm in diameter. It should be noted that this circular exit aperture was threaded, and intended to be combined with a tube that could be screwed into the exit aperture. The detector was placed at a working distance of 30 mm from the beam splitter housing surface. Desirably, good uniformity should be achieved over a range that includes the width of the point spread function of the electrostatic voltmeter probe and possible misalignment errors that may be typically a few millimeters large.

Figure 9:
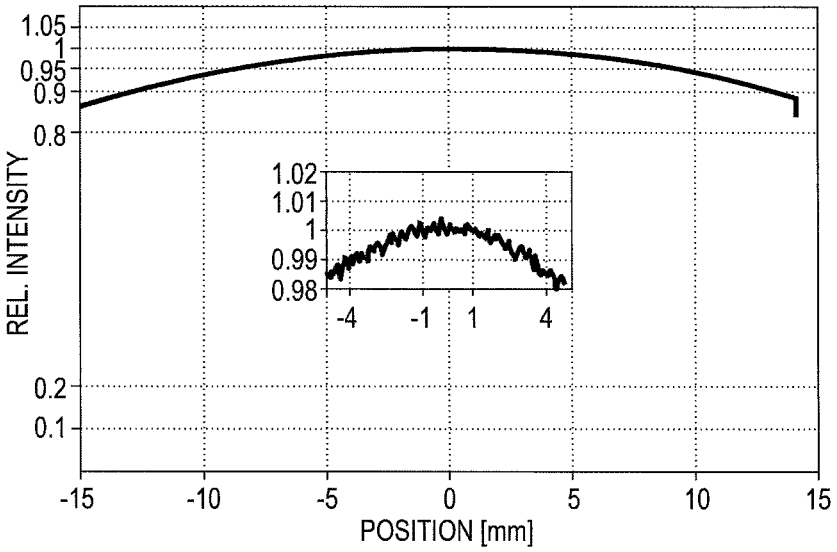
FIG. 9 is the power intensity distribution versus distance from the center of the beam in Example 1. Here, the device is only the light array and the beam splitter, with no barrel. The values are j=0 mm, e=25.4(?) mm diameter, and L=30 mm.

FIG. 9 shows the power distribution of the aforementioned arrangement, where j=0 mm, e=25.4 mm diameter, and L=30 mm. Two graphs are included here, a larger graph with an x-axis from −15 mm to +15 mm, and a smaller inset graph with an x-axis from −4 mm to +4 mm. The smaller inset graph is a magnified view of only a portion of the larger graph, and is intended to provide more information on the difference in intensity over a shorter distance. The power distribution is cylindrically symmetrical, and is not uniform, varying in relative intensity from below 0.9 to 1, i.e. about 10%.

Example 2

A black tube of nominal 1-inch (28.4 mm) length and nominal 1-inch inner diameter from Thorlabs was added to shield from stray light by screwing the tube into the exit aperture of the cuboid base. The distribution was measured at the same distance as Example 1. This corresponds to the device of FIG. 2 where j=28.4 mm, i=23 mm diameter (circular aperture), e=25.4 mm diameter (circular aperture), and L=4.6 mm.

Figure 10:
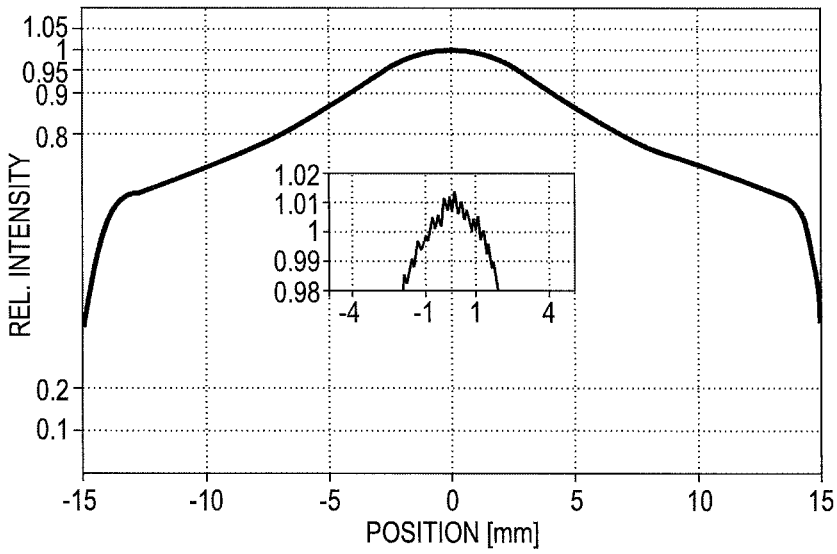
FIG. 10 is the power intensity distribution versus distance from the center of the beam in Example 2. The device adds a barrel of nominal 1-inch length (28.4 mm) and nominal 1-inch diameter to the device of Example 1. The values are j=28.4 mm, i=25.4 mm circular, e=25.4 mm circular, and L=4.6 mm from the front wall of the barrel.

The distribution is shown in FIG. 10. There was a marked drop at ±15 mm. This can be interpreted as less light reaching the margins due to the inclusion of the tube. However, uniformity suffered because of partial reflections off the sidewalls of the tube.

Example 3

Next, the exit aperture at the end of the black tube of Example 2 was changed from a circle of 25.4 mm diameter to a rectangular aperture of size 13.7 mm by 0.9 mm. The rectangular aperture was about 28 mm from the surface of the beam splitter. This corresponds to the device of FIG. 2 where j=22 mm, i=23 mm diameter, e=13.7 mm by 0.9 mm, and L=4.6 mm.

Figure 11:
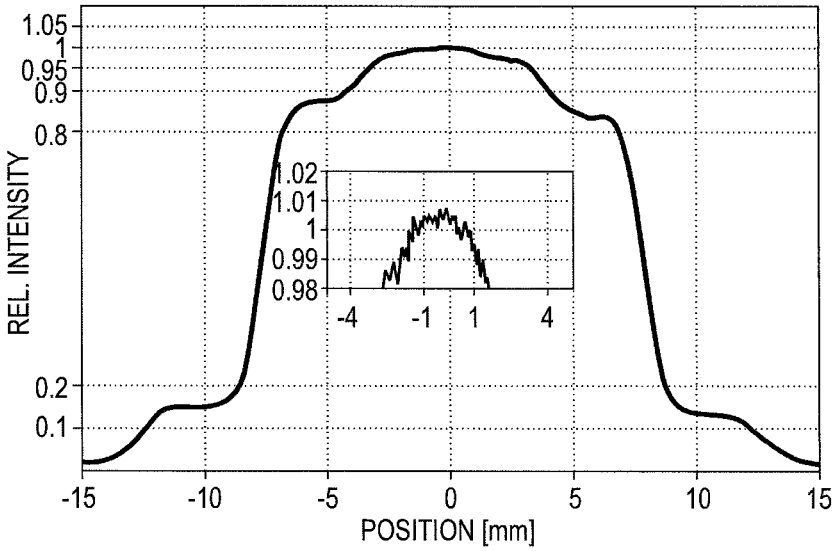
FIG. 11 is the power intensity distribution versus distance from the center of the beam in Example 3. The device of Example 2 is changed to have an exit aperture with a rectangular shape. The values are j=22 mm, i=23 mm diameter, e=13.7 mm by 0.9 mm, and L=4.6 mm. The distance from the front wall 112 to the surface of the beam splitter was 28 mm.

The distribution is shown in FIG. 11. The light was more confined, i.e. dropped off more quickly compared to FIG. 10, and dropped below 0.2 at approximately ±9 mm. However, the uniformity around the center was still poor, as seen in the smaller inset graph. There is a small plateau in uniformity at approximately ±5 mm.

Example 4

The inner aperture was modified by mounting a disk with a rectangular aperture of size 13.7 mm by 0.9 mm into the tube at a location about 7 mm away from the beam splitter surface. The long dimension of both slits were parallel. This corresponds to the device of FIG. 2 where j=21 mm, i=13.7 mm by 0.9 mm, e=13.7 mm by 0.9 mm, and L=4.6 mm.

Figure 12:
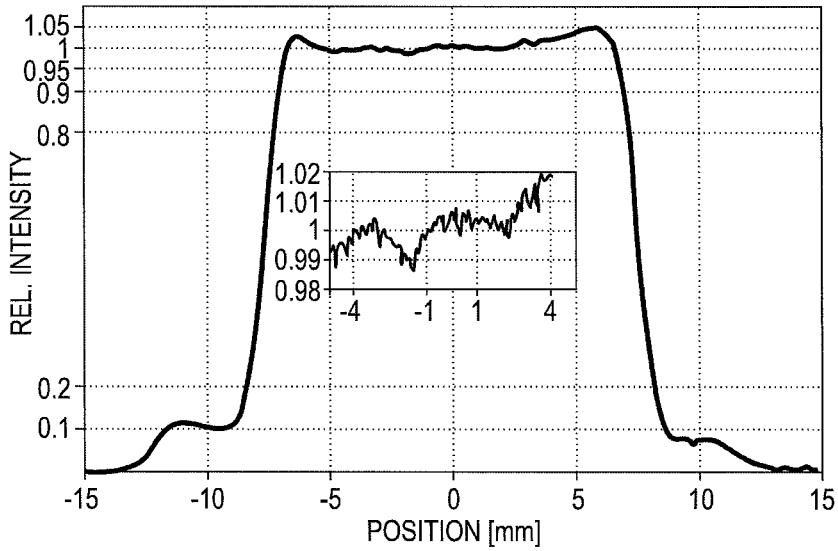
FIG. 12 is the power intensity distribution versus distance from the center of the beam in Example 4. The device of Example 3 is changed to also have an inner aperture with a rectangular shape. The values are j=21 mm, i=13.7 mm by 0.9 mm, e=13.7 mm by 0.9 mm, and L=4.6 mm.

The distribution is shown in FIG. 12. There is no small plateau as seen in FIG. 11, but the dropoff in intensity is about the same. The uniformity in intensity was better compared to FIG. 11. It is noted that the uniform plateau had a rough width of ±6 mm. There are two small increases in intensity at about ±11 mm, which are attributed to reflections from the side surfaces of the beam splitter. In the smaller inset graph, the intensity varied from 0.99 to 1.02 between the ±4 mm window, i.e. by 2% maximum.

Example 5

Figure 13:
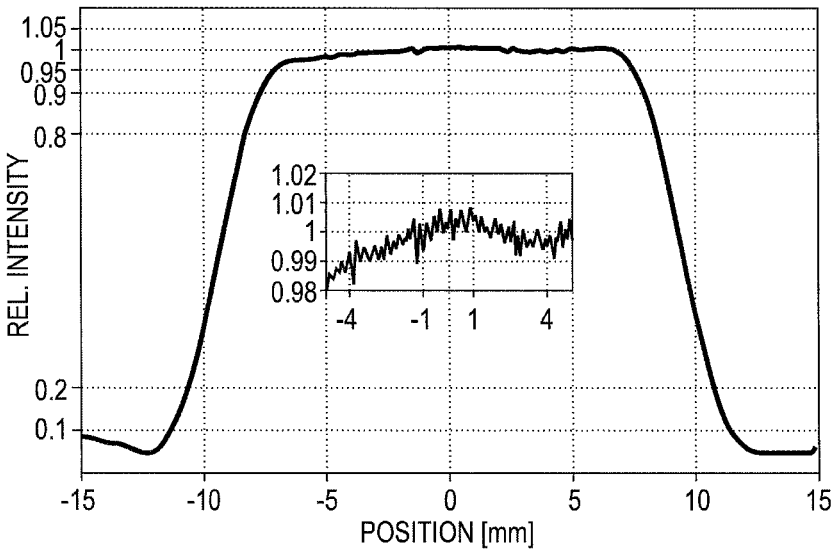
FIG. 13 is the power intensity distribution versus distance from the center of the beam when the device of Example 4 is measured at L=20 mm.

Next, the device of Example 4 was also measured at two different working distances L, 20 mm and 30 mm. The distribution for L=20 mm is shown in FIG. 13. The distribution for L=30 mm is shown in FIG. 14.

In FIG. 13, the uniform plateau had a rough width of ±7 mm, before dropping off in intensity. In the smaller inset graph, after removing the high frequency noise, the intensity swings about a total range of 1.4% in the ±4 mm window.

Figure 14:
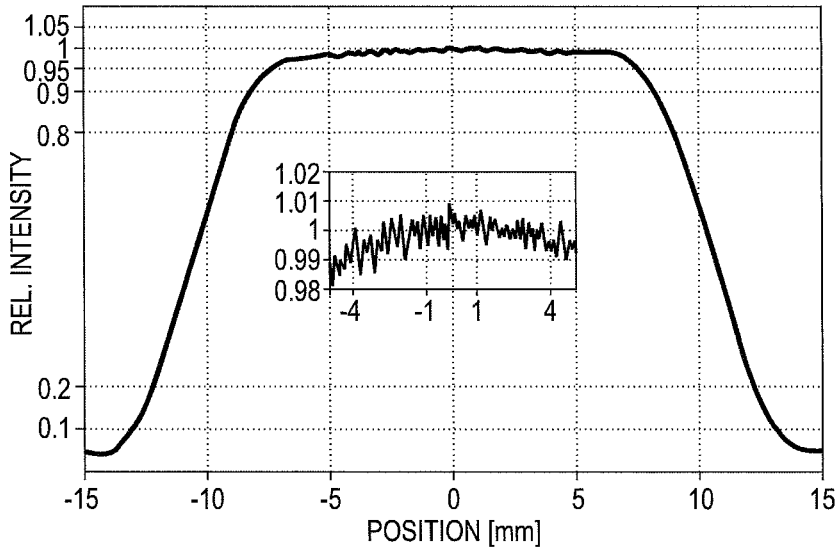
FIG. 14 is the power intensity distribution versus distance from the center of the beam when the device of Example 4 is measured at L=30 mm.

In FIG. 14, the uniform plateau had a rough width of ±7 mm, before dropping off in intensity. In the smaller inset graph, the intensity swing, after removing the noise, is slightly improved, about 1.1% in the ±4 mm window. These two figures had good uniformity. The electrostatic probe point spread function is about 2 mm, so including alignment errors the uniformity within the ±4 mm window is the relevant measure.

Example 6

The inner aperture was made a rectangular aperture of size 13.7 mm by 10 mm (i.e. wider width), and the blocking sheet was mounted directly on the beam splitter surface. This corresponds to the device of FIG. 2 where j=28 mm, i=13.7 mm by 10 mm, e=13.7 mm by 0.9 mm, and L=4.6 mm. (Note that the rectangular aperture is smaller than the circular 23 mm diameter of the tube which is screwed into the cuboid base, hence this diameter is not relevant for light shielding purposes.)

Figure 15:
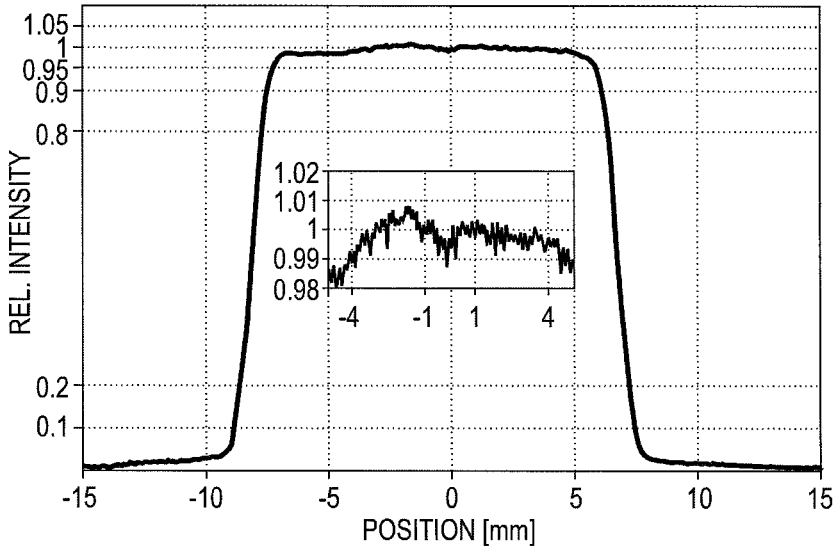
FIG. 15 is the power intensity distribution versus distance from the center of the beam in Example 6. Here, the inner aperture is moved to be directly upon the beam splitter. The values are j=28 mm, i=13.7 mm by 10 mm, e=13.7 mm by 0.9 mm, and L=4.6 mm.

FIG. 15 shows the power distribution for this arrangement. The side lobes disappeared, or in other words the dropoff in intensity is much sharper. Compared to FIG. 12, the reflections from the side surfaces of the beam splitter cube were removed. In the smaller inset graph, the intensity swings about a total range of 1.5% within the ±4 mm window.

Figure 16:
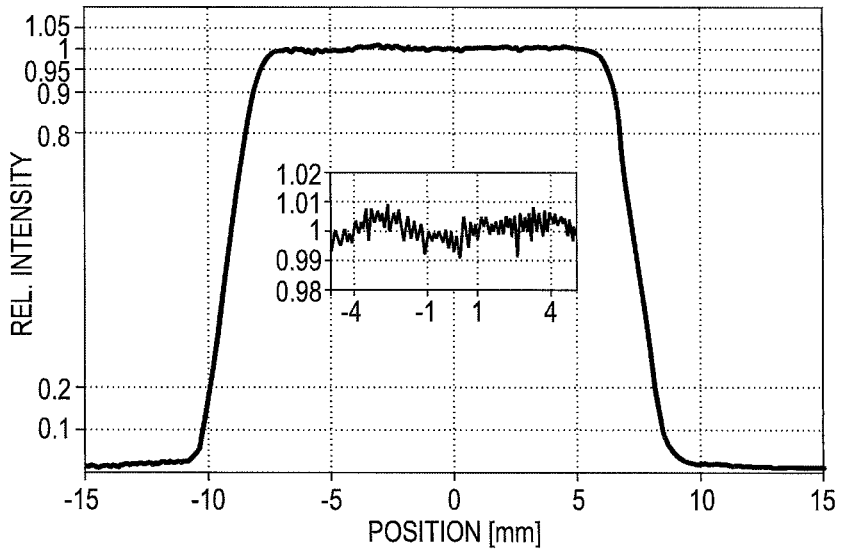
FIG. 16 is the power intensity distribution versus distance from the center of the beam in Example 6. Here, L=13 mm.

In FIG. 16, the only difference was the working distance was changed to 13 mm. The uniformity was improved compared to FIG. 15, with the intensity swing, after removing the noise, improving down to 0.9% within the ±4 mm window.

Figure 17:
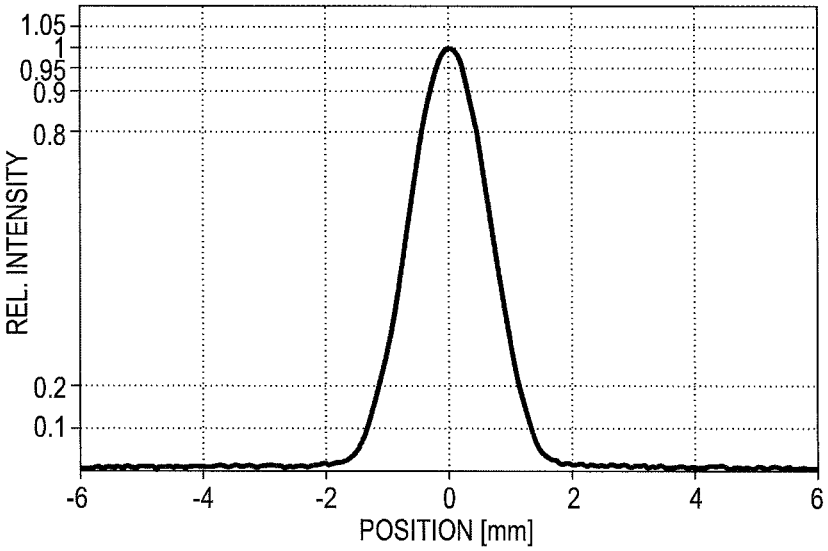
FIG. 17 is the power intensity distribution in the process direction (i.e the beam width) of the setup of FIG. 15.

FIG. 17 shows the power distribution for the arrangement of FIG. 15 in the process direction (not the critical direction). Note the difference in the x-axis.

Figure 18:
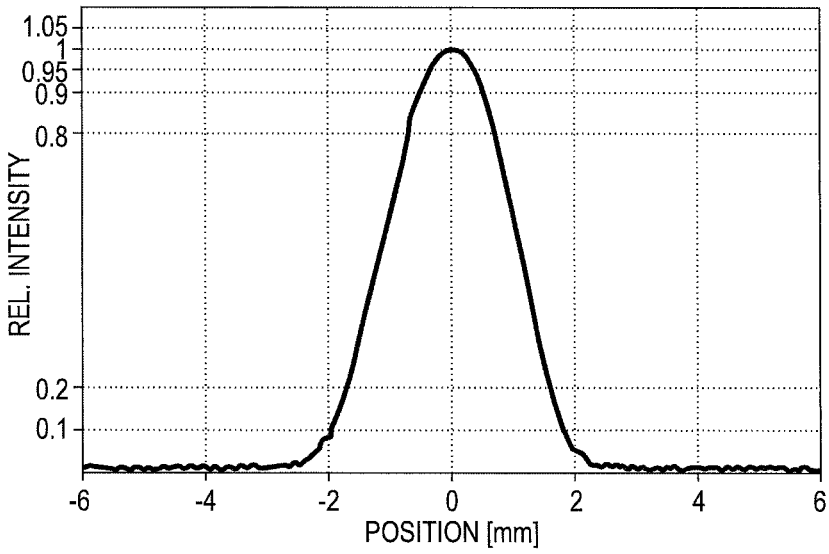
FIG. 18 is the power intensity distribution in the process direction (i.e the beam width) of the setup of FIG. 16.

FIG. 18 shows the power distribution for the arrangement of FIG. 16 in the process direction. These are adequate for the active area of the calibrating detector.

Example 7

A structure using a light channel as depicted in FIG. 4 and FIG. 5 was next tested, where the light channel had a width h=17.3 mm, a height w=1.6 mm, and a length g=38 mm. The light channel was made out of metalized circuit boards. A diffuse black layer was applied to all inner surfaces and the surfaces facing the beam splitter to reduce internal reflections. Unlike the prior examples, the light was controlled by absorption instead of trapping.

Figure 19:
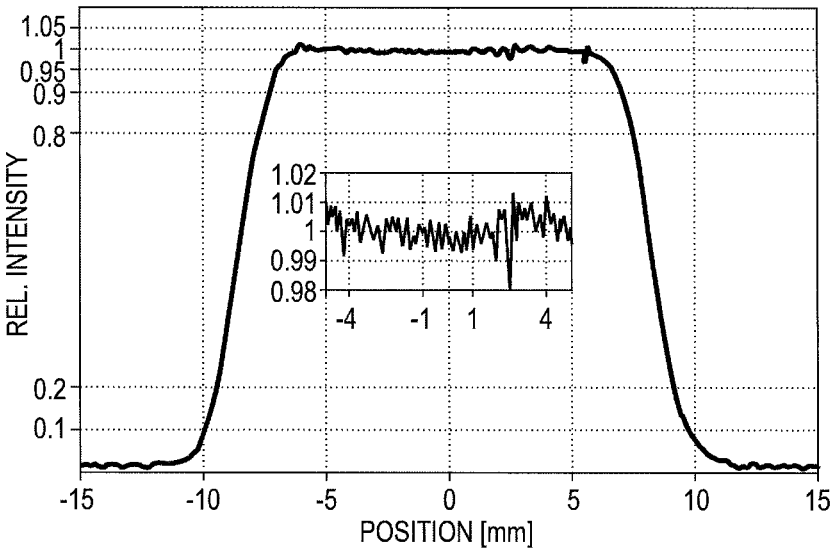
FIG. 19 is the power intensity distribution versus distance from the center of the beam in Example 7. A light channel is used as depicted in FIG. 4. The values are h=17.3 mm, w=1.6 mm, and g=38 mm.
Figure 20:
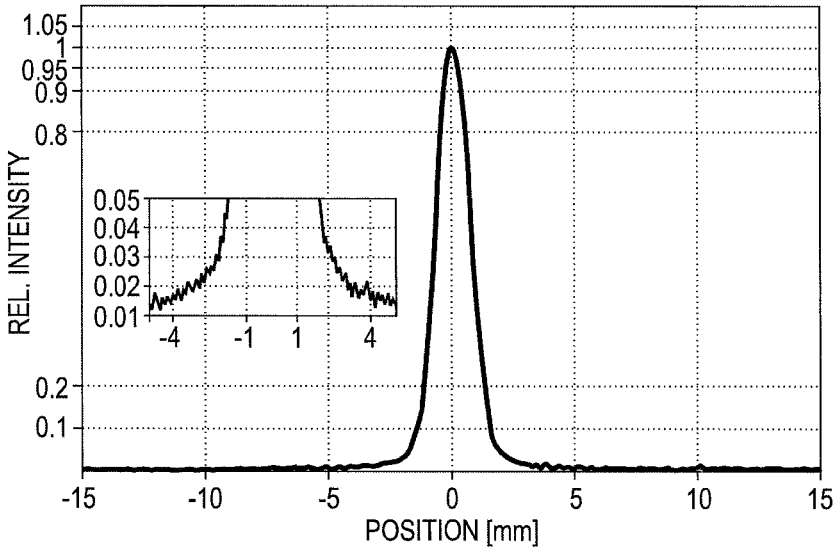
FIG. 20 is the power intensity distribution in the process direction (i.e the beam width) of the setup of FIG. 19.

The distribution is illustrated in FIG. 19 and the beam width profile is illustrated in FIG. 20. The beam width was defined as where the intensity was 1% of the maximum intensity. Here, the uniformity in FIG. 19 was again good, i.e., after removing the noise, the intensity swung in a range of 1%.

Not applying a black diffuse layer on the shiny metal surfaces increased the light throughput by a factor of about 4 at the expense of increasing the beam width by a factor of 2.5.

Example 8

An experimental testing system was constructed according to FIG. 8, using three shorter units for generating light of uniform intensity. The uniformity was measured for the device under three different conditions over a period of hours ranging from cold and moderate dry conditions, i.e., 2° C., 30% relative humidity, to hot and dry conditions, i.e., 38° C., 10% relative humidity, to hot and humid conditions, i.e., 38° C., 85% relative humidity. The uniformity was equal to or better than 1% spatially in all three conditions.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A testing system, comprising:

at least one device for generating a column of light having uniform intensity, the device comprising:

a housing;

a beam splitter located within the housing;

a two-dimensional array of light sources on a wall of the housing, the array being oriented towards the beam splitter such that light is split into a first beam and a second beam;

a detector port located to intercept the first beam for providing feedback; and an exit aperture on a front wall of the housing, through which the second beam exits the housing as a column of light having uniform intensity;

a plurality of congruent rings spaced apart from each other along an open central axis, each ring having its center on the open central axis; and a rail spanning the plurality of congruent rings;

wherein the at least one device is located on the rail and oriented with the exit aperture pointing towards the open central axis.

2. The system of claim 1, wherein the array of light sources is directly opposite the exit aperture.

3. The system of claim 1, wherein the front wall of the housing includes an inner aperture located between the beam splitter and the exit aperture.

4. The system of claim 3, wherein the inner aperture and the exit aperture are separated by a barrel that includes an interior barrel surface and has an aperture separation length, and wherein a form and size of the exit aperture, a form and size of the inner aperture, and the aperture separation length are independently adjustable.

5. The system of claim 1, wherein a light channel extends from the beam splitter through the exit aperture.

6. The system of claim 1, further comprising a mirror opposite the array of light sources, such that the second beam passes through the beam splitter, reflects off the mirror back towards the beam splitter, and then exits through the exit aperture.

7. The system of claim 1, wherein the exit aperture is circular or rectangular in shape.

8. The system of claim 1, wherein the two-dimensional array of light sources is a light-emitting diode (LED) array.

9. The system of claim 8, wherein the LED array is a rectangular array containing five rows of twelve AlGaAs diodes.

10. The system of claim 1, wherein the at least one device further comprises an alignment source oriented towards the beam splitter which generates an alignment beam that is reflected by the beam splitter and exits the housing through the exit aperture parallel with the column of light.

11. The system of claim 10, wherein the alignment source is located opposite the detector port.

12. The system of claim 1, wherein the detector port includes a photodiode that provides feedback to control the power applied to the two-dimensional array of light sources, the light sources being controlled as a group.

13. The system of claim 1, having a total of two congruent rings.

14. A method for assessing the quality of a photoreceptor comprising:

securing the photoreceptor along an open central axis of a testing system, wherein the testing system comprises:

at least one device for generating a column of light having uniform intensity, the device comprising:

a housing;

a beam splitter located within the housing;

a two-dimensional array of light sources, the array being oriented towards the beam splitter such that light is split into a first beam and a second beam;

a detector port located to intercept the first beam for providing feedback; and an exit aperture on a front wall of the housing, through which the second beam exits the housing as a column of light having uniform intensity;

a plurality of congruent rings spaced apart from each other along the open central axis, each ring having its center on the open central axis; and a rail spanning the plurality of congruent rings;

wherein the at least one device is located on the rail and oriented with the exit aperture pointing towards the open central axis; and rotating the photoreceptor while the at least one device illuminates the photoreceptor from a static position.

15. The method of claim 14, wherein a working distance between the front wall and the photoreceptor is 50 millimeters or less.

16. A device for generating a column of light having uniform intensity, comprising:

a housing;

a beam splitter located within the housing;

a two-dimensional array of light sources on a wall of the housing, the array being oriented towards the beam splitter such that light is split into a first beam and a second beam;

a detector port on a first side wall located to intercept the first beam for providing feedback;

an exit aperture on a front wall of the housing, through which the second beam exits the housing as a column of light having uniform intensity; and an alignment source on a second side wall oriented towards the beam splitter which generates an alignment beam that is reflected by the beam splitter and exits the housing through the exit aperture parallel with the column of light.

* * * * *